United States Patent [19]

Hocq

[11] 3,934,313

[45] Jan. 27, 1976

[54] BUTTON COVER

[75] Inventor: Robert Hocq, Boulogne-sur-Seine, France

[73] Assignees: Societe Franco-Hispano-Americaine (Francispam), Saint-Gratien; Societe Anonyme dite: Cartier, Paris, both of France

[22] Filed: Nov. 26, 1973

[21] Appl. No.: 418,986

[30] Foreign Application Priority Data

Nov. 29, 1972 France ..... 72.42414

[52] U.S. Cl. ..... 24/113 MP; 24/90.5

[51] Int. Cl.[2] ..... A44B 1/16

[58] Field of Search ..... 24/113 MP, 90.5, 245 R, 24/245 L, 245 F, 73 LF, 248 SL, 210, 223, 222 BS, 246; 51/265; 16/142, 184

[56] References Cited

UNITED STATES PATENTS

| | | | |
|---|---|---|---|
| 760,890 | 5/1904 | Mackinder | 16/142 |
| 791,953 | 6/1905 | Stimson | 24/245 L |
| 927,323 | 7/1909 | Bryant | 24/246 |
| 1,807,224 | 5/1931 | Mieres | 24/246 |
| 2,070,016 | 2/1937 | Lipton | 24/245 R |
| 3,316,601 | 5/1967 | Ryan | 24/113 MP |
| 3,353,231 | 11/1967 | Levine | 24/113 MP |

FOREIGN PATENTS OR APPLICATIONS

| | | | |
|---|---|---|---|
| 811 | 2/1880 | United Kingdom | 24/105 |

*Primary Examiner*—Paul R. Gilliam
*Assistant Examiner*—Kenneth J. Dorner
*Attorney, Agent, or Firm*—Brisebois & Kruger

[57] ABSTRACT

Button cover comprises a thin first part defining a hole to receive the button and a slit leading to said hole, said first part being hinged to an ornamental second part which covers the button. Spring means are provided for biassing the two parts together and a latch engages the slit when the cover is mounted on a button.

2 Claims, 6 Drawing Figures

BUTTON COVER

This invention relates to a cuff-button cover.

It is conventional to use cuff-links which are adapted to connect the two sides of the cuff of a shirt sleeve by engaging in the button holes which are positioned in each side of the cuff. These links ordinarily comprise a pair of metallic buttons which are usually pivotally connected to each other and adapted to connect the two button holes which are formed in the cloth.

Such cuff-links are generally used with folded back cuffs called "French cuffs" in which, on each side of the cuff, the cuff-link passes through two button holes in two thicknesses of cloth.

Cuff-links of this type are decorative devices for masculine use which are generally appreciated but the present tendency is to use fewer and fewer shirts having bent back cuffs and more and more shirts having simple cuffs which are fastened by a button attached to one side of the cuff which engages in a button hole in the other side.

The present invention relates to a button cover which may be placed on this type of cuff to hide the button which serves to fasten the cuff and constitute a decorative article of apparel.

The button cover according to the present invention has the advantages of being of simple and economic construction, and of being easy to put in place and hold on the button, even when the cuff is unbuttoned, as is the case when one puts on a shirt.

It is the object of the present invention to provide a button cover, and in particular a cuff-button cover, characterized by the fact that it consists essentially of a thin lower part having an opening the diameter of which is large enough to permit the button to pass flat therethrough, and which communicates with a slot inside which the thread which attaches the button to the sleeve may slide, this lower member being pivotally attached at the end remote from the slot to a second member, which is preferably hollow, having a surface sufficiently large to hide the button, and a device which holds the second member down on the first.

In a preferred embodiment of the invention the first member consists of a metallic wire symmetrically bent into the general shape of a U, the two ends of which are pivotally connected to the button cover. The U shape is such that it comprises a first rounded part, the diameter of which is greater than the diameter of the button, located near the pivot point, and a second part which is substantially straight and narrower, located at the summit of the U. In a particular embodiment the summit of the U is rounded and has a diameter slightly greater than the diameter of the remainder of the narrow part.

In accordance with a preferred embodiment of the invention the second member constituting the body of the button cover is a box, the bottom of which is designed to cover the button, which is encircled by the sides of the box.

Preferably the two parts are pivotally connected by a pin provided with spring stops which elastically maintain the two parts either perpendicular to each other or in a position in which they are biassed against each other.

In one embodiment this pivotal connection may be provided by a hinge having three tubular sections (two welded on the body of the button cover and a third welded to the U-shaped flat member).

In accordance with a preferred embodiment of the invention the end of the first member or body of the button cover which is remote from the pivotal connection to the other member carries a projection provided with two lateral recesses each adapted to resiliently engage between the two edges of the slot in the first member. This produces a sort of snap fastening which permits the attachment of the two members to each other in the position which they must occupy on the shirt when in use.

In order that the invention may be better understood one embodiment thereof will now be described, purely by way of illustration and example, with reference to the accompanying drawings on which:

Figure 1:
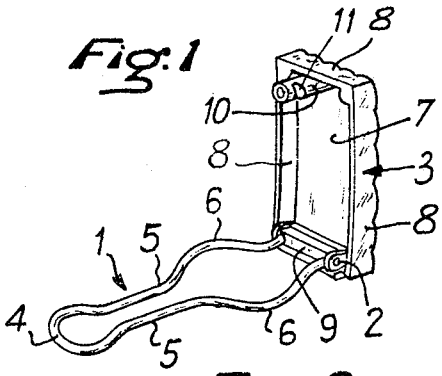
FIG. 1 is a perspective view of a button cover according to the invention shown in its open position.

FIG. 1 clearly shows the lower member 1 which is pivotally connected by the pin 2 to the member 3 which constitutes the main body of the button cover.

The lower member 1 consists of a metallic wire folded into a generally U shape. This member has a rounded tip 4 which is connected by two parallel parts 5 to the rounded part 6. The parallel parts are, in the present instance, separated by distance smaller than the diameter of the rounded part 4.

The rounded part 6 has a diameter which is sufficient to permit the passage of the button when flat. In other words, the diameter of the rounded part 6 is greater than the diameter of the button which closes the cuff.

The member 3 which hides the button is generally box-shaped and, in the present case, rectangular. This box has a bottom 7 and sides 8.

The member 3 is connected to the member 1 by a pivot pin 2, the member 1 being itself mounted on a bar 9 having a square section against which rests a spring fixed to the member 3. It is thus possible to bias the two members either into the position shown in FIG. 1 or into a position pressed against each other, as will hereinafter be explained.

On the body 3 is a projection 10 provided with two lateral recesses 11 which, as these two members swing with respect to each other, engage between the straight parts 5 of the member 1 with the recesses 11 engaging the parts 5 to hold the two parts in their closed position.

FIGS. 2 to 5 show the manner in which the new button cover may be easily mounted to cover the cuff button.

After having introduced the button 12 into the circular part of the member 1, the button cover is slid to bring the thread of the button toward the end 4 of the lower member. These operations are carried out while the cuff is open and are illustrated on FIG. 2.

Figure 3:
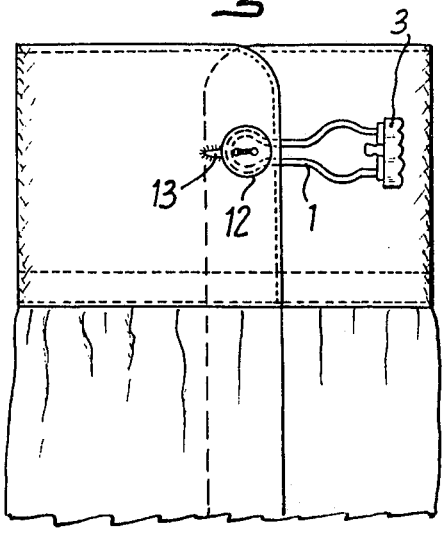
Figure 4:
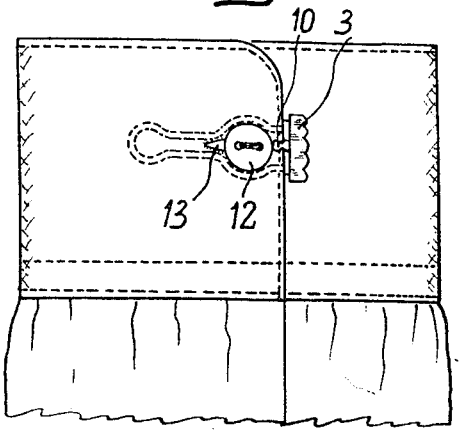

The button is then engaged in the button hole to produce the position shown on FIG. 3. The cuff being then closed, the button cover is pushed to the left to bring it into the position shown in FIG. 4, in which position the button 12 is substantially opposite the circular part 6 of the lower member 1. It then suffices to swing the upper member 3 to push the projection 10 through the button hole 13 so that in engages between the straight parts 5 of the member 1 and solidly holds these two members together.

Figure 6:
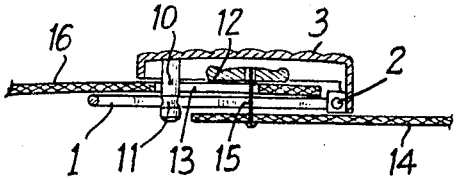
FIG. 6 is a sectional view on a larger scale, taken along the line VI—VI of FIG. 5.
Figure 2:
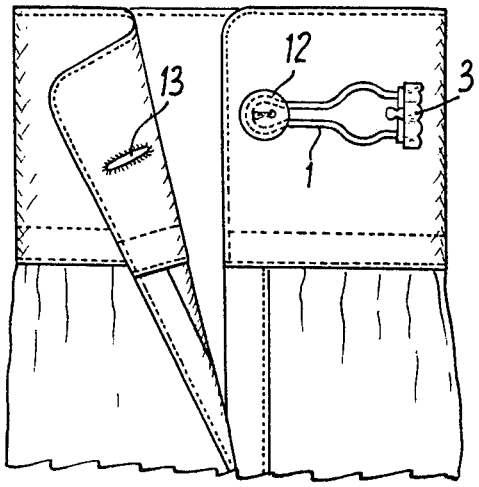
FIGS. 2 to 5 are schematic views showing how the button cover is mounted on a cuff-button.

FIG. 6 shows in section on a larger scale the lower side 14 of the cuff, which is provided with the button 12, attached by a button thread 15, and the upper side of the cuff which comprises the button hole 13 through which passes the button 12.

This figure clearly shows how the lower member 1 slides between the sides 14 and 16 of the cuff while encircling the button thread 15 and while the body 3 of the button cover is retained above the button 12 by the pin 10 the recesses 11 in which engage the straight parts 5 of the lower member 1.

It will be noted that the button cover according to the invention may be mounted in a particularly simple manner and that it totally covers the button, while constituting a decorative member analogous to cuff links.

It will also be noted that the button cover according to the invention is most generally made in the form of a jewel of precious metal equipped with several devices for preventing its loss.

Figure 5:
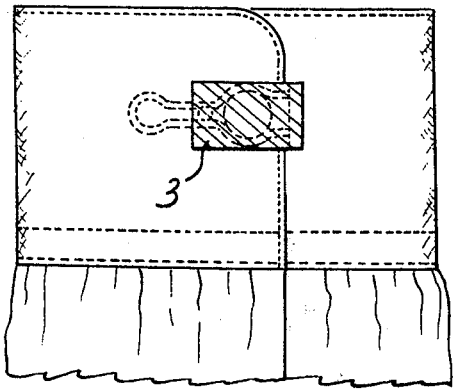

In the first place, in the position of use shown on FIGS. 5 and 6, it will be seen that even if the thread 15 of the button 12 breaks, the button cover will still be held on the side 16 of the cuff because the projection 10 is engaged in the button hole 13.

Furthermore, opening of the body 1 by disengagement of the projection 10 does not release the button cover which remains held by the thread 15 of the button 12 which passes through the lower member 1. This is true regardless of whether the button is or is not engaged in the button hole 13.

Finally, it will be noted that the mounting of the button cover in no way affects the cloth of the shirt because its maintenance is integrally assured by the thread 15 of the button 12 and by the button hole.

It will, of course, be understood that the embodiment which has just been described has been given purely by way of illustration and example and may be modified as to detail without thereby departing from the basic principles of the invention. In particular it is obvious that the lower member 1, instead of being made from a metallic wire, may, for example, be made from a thin plate having a recess corresponding to the shape which exists between the two arms of the wire of the embodiment described in the drawing.

Furthermore it is obvious that the body 3 of the button cover may have a different shape from the substantially parallellopipedic shape shown. It is not indispensable that it comprise the edges 8 as has been described.

Finally, it follows that the latching member, which, in the embodiment illustrated, consists of the projection 10, may have a different structure.

What is claimed is:

1. Button cover for cuffs comprising:

a first thin member comprising a first part defining a substantially circular recess having a diameter greater than that of a button to be covered, and a generally U-shaped second part including a slit leading to said recess and having a width less than said diameter, a second generally box shaped member having a bottom dimensioned to cover said button and sides adapted to lie on opposite sides of a button covered by said bottom, connecting means located in said second member adjacent one side thereof and pivotally connecting said second member to an end of said first part of said first member remote from said second part, said first and second members being pivotable with respect to each other between an open position wherein said first and second members are at an angle of substantially 90° to each other and a closed position in which said bottom and first member are parallel, the sides of said second member other than said one side being dimensioned to leave a small gap between themselves and the plane of the nearest surface of said first member parallel to said bottom when said first and second members are in said closed position, the width of said gap being equal to the thickness of a cuff, and fastening means for fastening said first and second members to each other in said closed position, said fastening means comprising a projection located in said second member close to the side thereof opposite said one side, said projection being provided with at least one lateral recess which resiliently engages a side of said slit when said first and second members are in said closed position.

2. Button cover as claimed in claim 1 in which said first member consists of a metallic wire folded to provide a rounded part defining said substantially circular recess, and two parallel parts defining said slit and a rounded tip, the diameter of which tip is slightly greater than the width of said slit but smaller than the diameter of said rounded part.

* * * * *